US005445103A

United States Patent [19]

Bleth et al.

[11] Patent Number: 5,445,103

[45] Date of Patent: Aug. 29, 1995

[54] ANCHOR DRIFT INDICATOR

[76] Inventors: Joel Bleth; Barb A. Bleth, both of 656 21st St. W., Dickinson, N. Dak. 58601

[21] Appl. No.: 877,202

[22] Filed: May 1, 1992

[51] Int. Cl.[6] ..... B63B 22/08

[52] U.S. Cl. ..... 114/293; 441/3; 441/6

[58] Field of Search ..... 114/230, 293, 294; 441/11, 3, 6

[56] References Cited

U.S. PATENT DOCUMENTS

| | | | |
|---|---|---|---|
| 2,562,922 | 8/1951 | Kist . | |
| 3,307,208 | 3/1967 | Jacobson . | |
| 3,948,201 | 4/1976 | Takeda et al. | 114/293 |
| 4,808,133 | 2/1989 | Gram et al. . | |
| 4,839,873 | 6/1989 | Cochrane et al. | 114/293 |
| 4,912,464 | 3/1990 | Bachman | 114/293 |
| 5,066,256 | 11/1991 | Ward | 441/11 |

FOREIGN PATENT DOCUMENTS 62-262524 11/1987 Japan .

OTHER PUBLICATIONS

Photocopy of Picture Taken on Northeast River, Md., Circa Aug. 1969, Property of C. E. Van Horn.

*Primary Examiner*—Stephen P. Avila
*Attorney, Agent, or Firm*—Richard C. Litman

[57] ABSTRACT

An anchor drift warning system includes an anchor indicating buoy and a reference buoy. Each buoy includes a floating housing, a light, a battery, solar powered battery recharger, and a spool. Radio signaling apparatus may be included to provide alarm indication aboard the vessel. A line retractably held in the spool of the indicating buoy is attached to the main anchor of the vessel. A line retractably held in the spool of the reference buoy is attached to its own anchor or to a weight. Both buoys are stowed proximate the anchor, and discharged into the water when the vessel main anchor is deployed. The reference buoy is substantially immobile upon deployment. The indicating buoy will move with the anchor, if the anchor has failed to be immobilized by solid engagement with the water bottom. Visual indication of this condition is provided by increasing distance between the indicating buoy and the reference buoy.

11 Claims, 2 Drawing Sheets

ANCHOR DRIFT INDICATOR

FIELD OF THE INVENTION

The present invention relates to an anchor position marking system for boats, and more particularly to an anchor drift indicating system.

DESCRIPTION OF THE PRIOR ART

Marking the position of an anchor used to moor a water going vessel is known, as exemplified by U.S. Pat. No. 4,808,133, issued to Michael Gram et al. on Feb. 28. 1989. Gram et al. disclose a tensioning system to allow a floating marker sufficient length tether to remain on the water surface regardless of anchor depth, but provide enough tension to control drift of the marker on the water surface.

In U.S. Pat. No. 2,562,922, issued on Jun. 13, 1949, F. C. Kist discloses a marking buoy independently positioned on the floor of a body of water by a weight.

U.S. Pat. No. 3,307,208, issued to Don L. Jacobson on Mar. 7, 1967, exemplifies floating signal lights.

Japanese Pat. No. 62-262524, issued on Nov. 14, 1987, to Tatsuo Yoshikawa, discloses an alarm activated when a radio transmitter and a cooperating receiver are separated by more than a preset distance.

None of the above inventions and patents, taken either singly or in combination, is seen to describe the instant invention as claimed.

SUMMARY OF THE INVENTION

The prior art has largely concerned itself with the problem of locating and retrieving anchors; however, an unaddressed problem is that of determining whether secure anchorage occurs. If an anchor fails to secure itself securely on the ocean bottom or the like, it is possible for the associated vessel to drift imperceptibly, dragging its anchor along the bottom. Of course, the principles presented herein apply equally to all navigable bodies of water: for brevity, the terms "ocean" and "ocean bottom" will be understood to encompass all such bodies of water. In areas near dangerously shallow bottoms, submerged rocks, or mooring or fishing lines, this drift is unacceptable. It therefore is desirable to determine whether the anchor is drifting in addition to determining the location of the anchor.

The present invention provides visual indication of the relative positions of a reference buoy and an anchor locating buoy, the latter being fixed to the anchor. The two buoys are initially located in close proximity upon anchor deployment, and a discrepancy in proximity indicates anchor drift.

When the main anchor of the vessel is deployed, the reference and anchor locating buoys are also deployed. The reference buoy has a tethering line paid out by a spool, the line attaching to its own anchor. The reference buoy is not connected to the vessel or the main anchor, and the mass of its anchor positively fixes the reference buoy in its initial deployed position. The anchor locating buoy is attached to the main anchor.

Each buoy includes reflectors, a lamp, a switch and a light detector to control the lamp, a flasher to govern frequency of lamp illumination, a battery, and a radio transmitter. The reference buoy sends an inhibiting signal to a receiver in the anchor locating buoy. In the absence of inhibition, the anchor locating buoy sends an alarm signal back to the parent vessel. The alarm signal activates an alarm annunciating detection of anchor drift.

The inhibition signal is weak, and effective only when the two buoys are in close proximity. When anchor drift separates the buoys sufficiently, the inhibition signal is ineffective, and the alarm signal is successfully transmitted.

In addition to the radio signal, the buoys may be seen to be separating. The lamp permits this same visible indication at night. Observation is facilitated by the reflectors, which are illuminated by sunlight during the day, or by flashlight or by spotlight at night.

The switch is settable to any of three positions. "Off" is used to deactivate the lamp when it is not needed, thus saving power. "On" is used to test the system. In the "automatic" mode, the decision to light the lamp is left to the light detector, so that the light will operate only at night. The switch is magnetically actuated from the outside of the buoy, so that no control apparatus need penetrate the buoy wall, and thus be exposed to a harsh marine environment.

The anchor locating buoy tethering line also assists in retrieval of the anchor when it is desired to resume sailing.

In an alternative embodiment, photovoltaic cells mounted on the buoys maintain the batteries charged.

Accordingly, an object of the present invention is to provide visible indication of change in anchor position.

A second object is to mark an initial anchor position on the bed of a body of water.

Another object is to provide an anchor drift indicator which is visible in the dark.

Still another object is to provide an anchor drift indicator which assists in anchor retrieval.

A further object is to provide an anchor drift indicator which provides automatic indication of anchor drift.

A still further object is to provide an anchor drift indicator which maintains an electrical power supply charged.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
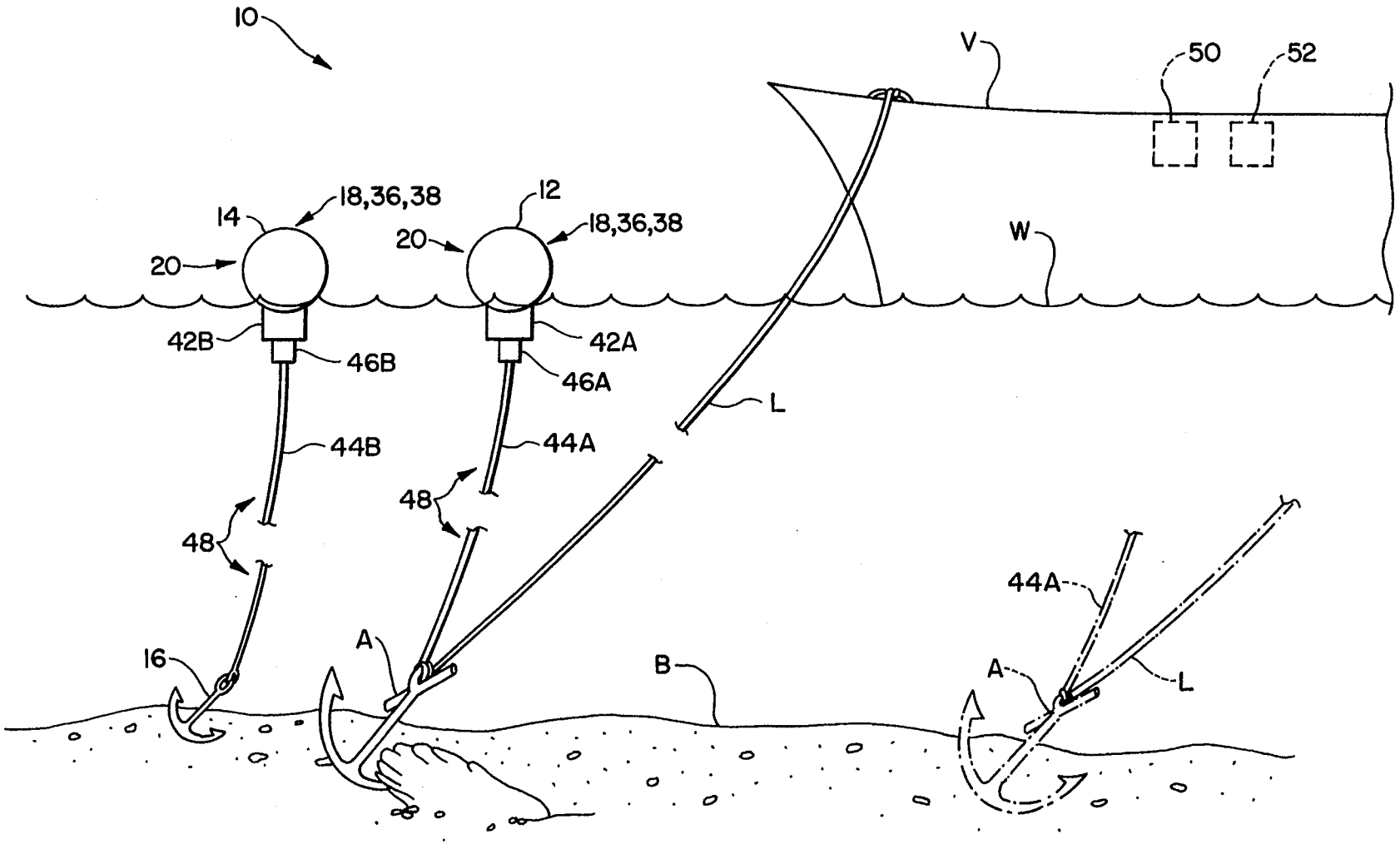
FIG. 1 is an environmental view of the present invention as deployed.

As seen in FIG. 1, the present invention 10 comprises an anchor locating buoy 12 tethered to a main vessel anchor A by a line 44A and a reference buoy 14 tethered to a separate anchor 16 by a line 44B. For brevity, the term "anchor" will be understood to include any suitable weight or device positively securing the reference buoy in place. Both buoys 12, 14 are normally stowed on board an oceangoing vessel V, preferably proximate the main anchor A. When deployed, the main anchor A includes an anchor line L, of course.

Figure 2:
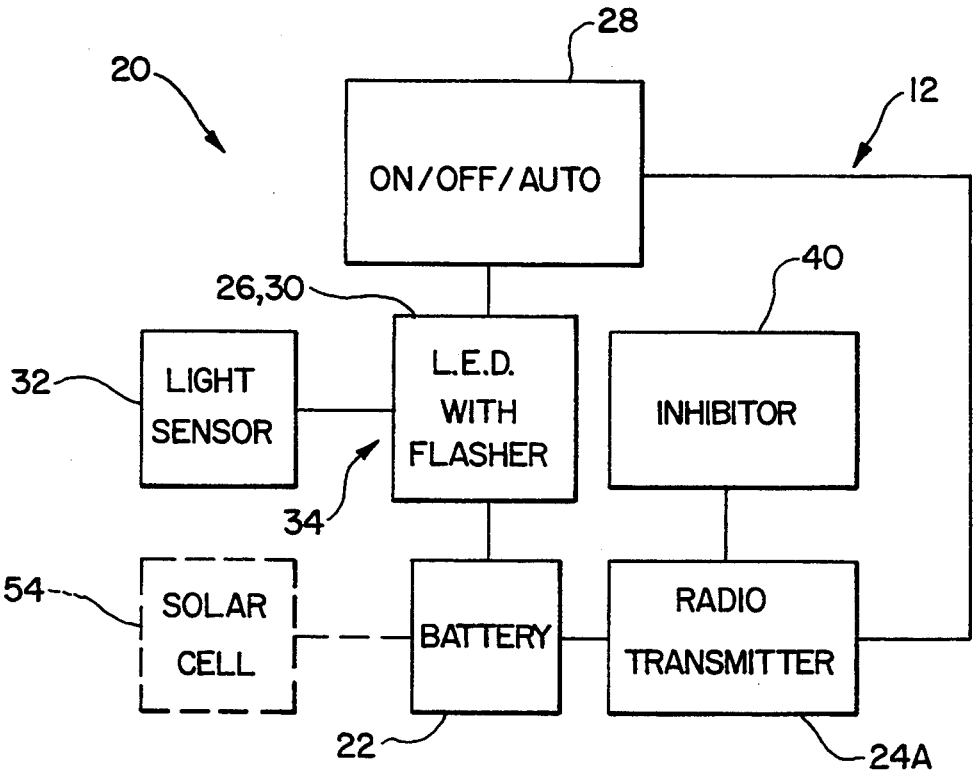
FIG. 2 is a block diagram of the electrical components of the anchor indicating buoy.
Figure 3:
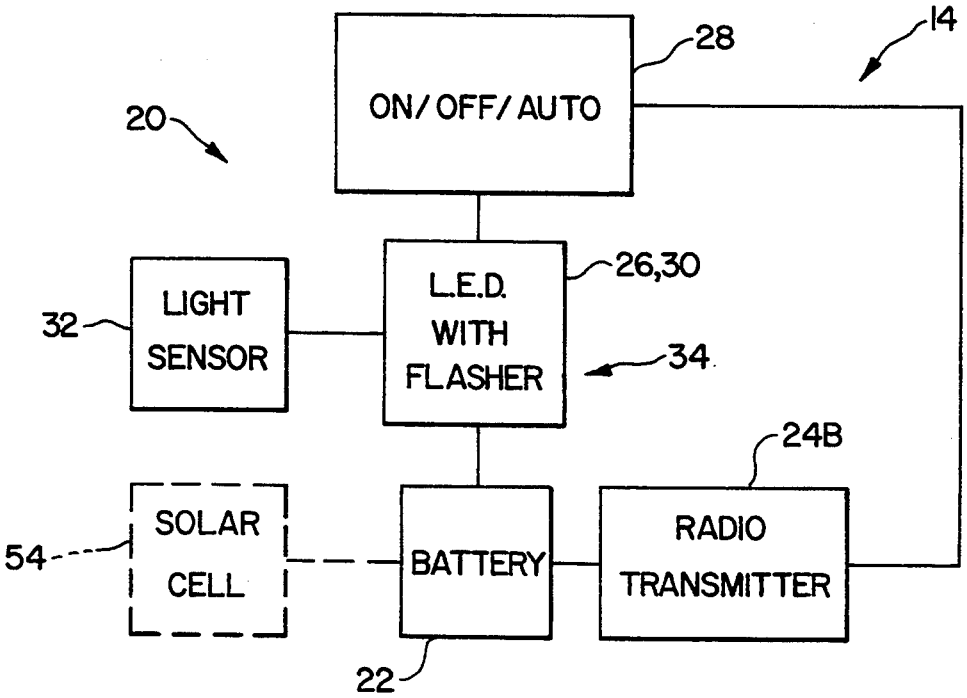
FIG. 3 is a block diagram of the electrical components of the reference buoy.

Better shown in FIGS. 2 and 3, each buoy 12, 14 is made up of a transparent floatable housing 18 containing an electrical system 20 including a battery 22, a radio transmitter 24A or 24, an indicating light 26, a three position magnetically actuated switch 28, a flasher 30, and a light sensor 32. The indicating light 26 is preferably a plurality of low energy light emitting diodes 34, hereinafter referred to as LEDs. Power consumption of the light is sufficiently low that two size AA. 1.5 Volt battery cells, when the light is controlled by a flasher that operates on a 5 per cent on, 95 per cent off timing cycle, will yield in excess of 900 operating hours.

The three position switch 28 is magnetically controlled in a well known fashion, and is mounted near the housing wall 36 so as to be operable externally. When the present invention 10 is not in use, the switch 28 is left in an "Off" position to conserve electrical power. The indicating light 26 may be tested by moving the switch 28 to the "On" position. The switch 28 is left in the "Automatic" position prior to deployment. The light 26 will then be controlled by the light sensor 32, and the radio transmitters 24A, 24B will be operative. The light sensor 32 is set to operate the light 26 during darkness. When operating, the light 26 is periodically illuminated according to the timing cycle described above.

Each buoy 12, 14 also contains multicolored reflectors 38. The anchor locating buoy 12 further has a radio transmission inhibitor 40.

Each buoy 12, 14 is attached to a spool 42A, 42B, respectively, which pays out a line 44A or 44B tethering the buoys 12, 14 to their respective anchors A, 16. Each buoy 12 or 14 further includes a line lock 46A or 46B of a known type which limits the length of line dispensed from the respective spools 42A, 42B upon deployment. The lines 44A, 44B are sufficiently strong as to be able to support their respective anchors A, 16 during retrieval.

The tie line 44A from anchor locating buoy 12 is manually attached to the vessel main anchor A, as by a snap hook. When the main anchor A is deployed and sinks to the ocean bottom B, the operator notes the amount of tie line 44A paid out. This amount is indicated by markers 48 periodically located along the line, known in the nautical field as "rode markers".

The operator then sets the line lock 46B on the reference buoy spool 42B to an equivalent length, and ejects the reference buoy 14 and its anchor 16 into the water W. The two buoys 12, 14 are now deployed in close proximity, with substantially equal length lines 44A, 44B tethering the buoys 12, 14 to their respective anchors A, 16. Proximity of the buoys 12, 14 and of their respective anchors A, 16 is shown in solid lines in FIG. 1.

Upon failure to detect a preset ambient light level, the light sensors 32 activate the lights 26, so that each buoy 12, 14 may be visible at night. If the main anchor A has securely lodged in the ocean bottom B, these lights 26 remain close to one another, floating on the ocean surface. In daylight, the buoys 12, 14 are of sufficiently distinctive appearance as to be readily discernible from the vessel V.

However, if the main anchor A has failed to securely attach to the ocean bottom B, then the vessel V may drift in response to wind or water currents. The relatively great mass of the vessel V may pull the anchor A along the ocean bottom B. The anchor locating buoy 12 will be pulled along substantially with the vessel V, and away from the immobile reference buoy 14. This condition is illustrated in part by the phantom representation in FIG. 1 of the main anchor A together with its associated main and buoy lines L, 44A. Of course, the vessel V and the anchor locating buoy 12 drift to a degree corresponding to similar drift of the main anchor A from the position shown in FIG. 1, although a new position is not specifically illustrated. This discrepancy in proximity of the buoys 12, 14 is visible to an observer aboard the vessel V, and thus indication of anchor drift is provided.

An automatic alarm signal is sent to a radio receiver 50 and a suitable alarm 52 on board the vessel V in the following fashion. The anchor locating buoy 12 has a radio transmitter 24A which is constantly attempting to send an alarm signal which will actuate the vessel alarm 52, which alarm 52 is any suitable and well known audible or visible alarm. The reference buoy 14 has a radio transmitter 24B which sends out a weak signal to inhibit transmission of the alarm signal by radio transmitter 24A of the anchor locating buoy 12. When a preset distance separates the two buoys 12, 14, as would be the case if anchor drift occurs, the inhibiting signal from transmitter 24A is not received by the inhibitor 40, and the alarm signal prevails. An example of an arrangement to accomplish this is seen in Japanese Patent No. 62-262524, to Yoshikawa.

The anchor locating buoy 12 further finds utility in assisting to retrieve the main anchor A. Since an anchor engages the ocean bottom B securely when properly deployed, a pull on the anchor line will not dislodge the anchor; a pull from a different direction is likely to be more effective. Since the anchor locating buoy 12 is accessible and firmly tethered to the anchor A, the associated tether line 44A may serve in this capacity, known in the nautical world as a trip line.

In an alternative embodiment, photovoltaic arrays 54, 54 are disposed on buoys 12, 14 to maintain the batteries 22 charged.

It is to be understood that the present invention is not limited to the embodiments described above, but encompasses any and all embodiments within the scope of the following claims.

I claim:

1. For use with art ocean going vessel having a main anchor, an anchor drift indicator comprising:

a first, floating buoy having a first tether line attached to the vessel main anchor, said first tether line having markers disposed therealong;

a first spool included in said first buoy for dispensing said first tether line, whereby the dimension of a length of dispensed tether line may be determined with said markers;

a first line lock, whereby the length of said first tether line dispensed upon deployment of said first buoy is determined, and said first line lock is operable to limit said first tether line dispensed by said first spool to a desired length;

a floating reference buoy having a second tether line and a second anchor, said reference buoy being secured to the ocean bottom by said second anchor, said second tether line having markers disposed therealong;

a second spool included in said reference buoy for dispensing said second tether line, whereby the dimension of a length of dispensed tether line may be determined with said markers; and a second line lock, whereby the length of said second tether line dispensed upon deployment of said reference buoy is determined, and said second line lock is operable to limit said second tether line dispensed by said second spool to a desired length;

said first and said reference buoys being deployed in close proximity to one another and being visible from the vessel, whereby upon failure of the main anchor to firmly engage the ocean bottom, the main anchor is pulled by the vessel, and a distance divergence between said first and said second buoys is visible from the vessel, indicating that the vessel and the main anchor are drifting.

2. An anchor drift indicator as claimed in claim 1, further comprising:

a first light means disposed upon said first buoy; and a second light means disposed upon said reference buoy, whereby said first buoy and said reference buoy are readily discernible at night.

3. An anchor drift indicator as claimed in claim 2, each of said first buoy and said reference buoy having an electrical supply means disposed therein and switch means, whereby said first and second light means are electrically powered by said electrical supply means, and controlled by said switch means.

4. An anchor drift indicator as claimed in claim 3, each of said buoys having an exterior wall and wherein said each of said switch means comprise a magnetically actuated switch located sufficiently close to a buoy exterior wall so as to be operable from outside said buoy exterior wall, whereby no portion of said switch means extends to the exterior of a buoy and thus said switch means is not exposed to a marine environment.

5. An anchor drift indicator as claimed in claim 3, further including first and second photovoltaic arrays for recharging said first buoy electrical supply means and said reference buoy electrical supply means respectively.

6. An anchor drift indicator as claimed in claim 2, said first and second light means comprising light emitting diodes.

7. An anchor drift indicator as claimed in claim 1, each of said buoys further including reflectors visible from the exterior of said buoys.

8. An anchor drift indicator as claimed in claim 1, said first buoy tether line being of sufficient predetermined strength to support the main anchor during anchor retrieval, said first buoy and said first buoy tether line providing a trip line.

9. An anchor drift indicator as claimed in claim 1, said first and said reference buoys being stowed on a rail of a boat, whereby ready deployment is enabled.

10. For use with an ocean going vessel having a main anchor, an anchor drift indicator comprising:

a first buoy having an exterior wall;

a first tether line attaching said first buoy to the vessel main anchor;

a first light disposed on said first buoy;

a first electrical supply means for supplying electricity to said first light;

a first magnetically actuated switch controlling said first light, said first switch located within said first buoy sufficiently close to the exterior wall of said first buoy so as to be operable from outside the exterior wall of said first buoy, whereby no portion of said first switch extends beyond the exterior wall of said first buoy and thus said first switch is not exposed to a marine environment;

a reference buoy having an exterior wall;

a second anchor for positive securement to an ocean bottom near the main anchor;

a second tether line attaching said reference buoy to said second anchor;

a second light disposed on said reference buoy;

a second electrical supply means for supplying electricity to said second light;

a second magnetically actuated switch controlling said second light, said second switch located within said reference buoy sufficiently close to the exterior wall of said reference buoy so as to be operable from outside the exterior wall of said reference buoy, whereby no portion of said second switch extends beyond the exterior wall of said reference buoy and thus said second switch is not exposed to a marine environment, whereby upon failure of the main anchor to firmly engage the ocean bottom, the main anchor will drag along the ocean bottom causing said first buoy to change position, this change in position being clearly visible from the vessel as a divergence between said first buoy and said reference buoy which remains stationary, this change in position indicating anchor drift.

11. An anchor drift indicator comprising:

a first, floating buoy attachable to the main anchor of an ocean going vessel by a first tether line, wherein said first buoy is tethered to the main anchor and floats on the ocean surface, said first buoy including a radio transmitter means for sending a signal to the vessel and a radio receiver means operating to inhibit said transmitter upon receipt of an inhibiting signal;

a floating reference buoy attached to a second anchor by a second tether line, said reference buoy being deployed in close proximity to said first buoy, said reference buoy being secured by said second anchor to a location on the ocean bottom, said reference buoy also floating on the ocean surface in close proximity to said first buoy, said reference buoy including a second radio transmitter means operable to send a weak inhibiting signal, receivable by said first buoy radio receiver means; and alarm means on the oceangoing vessel, and a second radio receiver means operable for actuating said alarm means upon separation beyond a predetermined proximity of said first buoy and said reference buoy, a weak inhibiting signal from said second radio transmitter means not being received by said first buoy radio receiver means whereupon said first buoy radio transmitter means sends a signal to said vessel radio receiver means, thus actuating said alarm means to indicate a condition of anchor drift.

* * * * *